United States Patent [19]

Hildebrand et al.

[11] 4,236,756

[45] Dec. 2, 1980

[54] STREET SWEEPER HAVING AN ELEVATING HOPPER WITH SUPPORTING OUTRIGGERS

[75] Inventors: Donald L. Hildebrand, Union; Ernest F. Prescott, Elgin, both of Ill.

[73] Assignee: Elgin Sweeper Company, Elgin, Ill.

[21] Appl. No.: 966,494

[22] Filed: Dec. 4, 1978

[51] Int. Cl.[3] ..... B60P 1/04; E01H 1/04

[52] U.S. Cl. ..... 298/11; 15/84; 212/145; 280/764; 298/17 SG; 414/420

[58] Field of Search ..... 298/11, 17 S, 17 SG, 298/1 C; 414/471, 702, 408, 409, 419, 420, 421, 495, 542-546, 555; 212/145; 280/764; 15/78, 83, 84, 340

[56] References Cited

U.S. PATENT DOCUMENTS

| | | | |
|---|---|---|---|
| 2,189,052 | 2/1940 | Anthony | 298/17 SG X |
| 3,744,653 | 7/1973 | Jensen | 298/17 SG X |
| 3,854,750 | 12/1974 | Voehringer | 280/764 |
| 3,870,276 | 3/1975 | Phillips | 280/764 X |
| 4,059,942 | 11/1977 | Trimble et al. | 298/17 S X |
| 4,171,551 | 10/1979 | Hildebrand et al. | 15/84 |
| 4,178,647 | 12/1979 | Wolynec et al. | 298/1 C X |

FOREIGN PATENT DOCUMENTS

| | | | |
|---|---|---|---|
| 679898 | 9/1952 | United Kingdom | 298/17 SG |

*Primary Examiner*—L. J. Paperner

*Attorney, Agent, or Firm*—Hill, Van Santen, Steadman, Chiara & Simpson

[57] ABSTRACT

A street sweeper having a frame with a cab positioned at a forward end of the frame. A hopper is provided for receiving sweepings carried on the frame behind the cab. Linkage is further provided for enabling the hopper to be moved over the cab to a forward dumping position. Outriggers are positioned at a forward end of the sweeper. Hydraulic circuit means, valve means, and ram means collectively cooperable together and sequentially operable to initially move the outriggers into ground engagement to provide additional support for the hopper when in the forward dumping position and then operable to actuate the linkage to move the hopper over the cab for dumping.

11 Claims, 6 Drawing Figures

10
11
12
13
14
15
15a
16
16a
17
18
19
20
21
22
23
25
26
27
28
81
83
89
92
93
94
95
96
96a
100
330
338
339
S

STREET SWEEPER HAVING AN ELEVATING HOPPER WITH SUPPORTING OUTRIGGERS

BACKGROUND OF THE INVENTION

1. Field of the Invention

The present invention relates to a street sweeping machine.

2. Prior Art

Street sweepers that can elevate a bin full of sweepings and dump them into an open truck bed or similar container have been known for some time. Garbage or trash collection vehicles that pick up containers, either fixed to the lift arms or separable from the lift arms, and move the container over the top of the vehicle cab for dumping the container contents into the collection vehicle have been known for some time. The visibility advantage of forward positioning of an operator in a vehicle has been known for some time.

SUMMARY OF THE INVENTION

This invention describes a street sweeper which sweeps up debris from the street and stores it in a hopper-like container until the container is full. The operator of this street sweeper is located at the front of the sweeper and on the centerline of the sweeper. The operator can position the street sweeper in a dumping relationship with an operated truck (or similar collection vehicle), apply wheel brakes on the sweeper, and proceed to dump the contents of the sweeper dirt container onto a truck bed of the vehicle located in front of the parked sweeper. This sweeper may also be used for dumping sweepings onto piles off of the road or over walls or into railroad cars. According to important aspects of the disclosed invention, the street sweeper has been provided with outriggers which are positioned at a forward end of the sweeper and which serve to support the sweeper so that when the loaded hopper is moved over the cab and forward of the cab into a dumping position, the center of gravity of the sweeper will not be altered to such an extent that the sweeper will tip. This allows for safe dumping when the sweeper is headed downhill as on a street surface with a 5% slope or in an "off road" dump where the front wheels may sink into soft ground and tilt the sweeper.

According to important objects of this invention, we have provided a new and improved street sweeper with a linkage supported hopper which linkage is operable to cause the hopper to move from a supported position on the frame behind the cab to a position above and forward of the cab for dumping the hopper along with outriggers positioned beneath a forward end of the machine sweeper or machine to facilitate a smooth dumping operation.

Another important object of this invention is to provide a hydaulically operated linkage system for elevating a hopper which is connected with hydraulic circuit means, valve means and ram means collectively cooperable together and sequentially operable to initially move the outriggers into ground engagement to provide additional support for the hopper when in its forward dumping position and then operable to actuate the linkage to move the hopper over the cab for dumping.

Other features of this invention relate to so orienting the valve means that it is operable to block fluid flow in and out of the outrigger ram means, thus maintaining the outriggers in ground engagement as the hopper is raised and lowered until the hopper is lowered to a predetermined point when said outrigger valve means is operative to actuate the outrigger ram means and to allow the outriggers to be raised into a travel position, which overall operation can be accomplished with a single manual valve by the operator in the sweeper cab so that a second manually operable valve is not required in the cab to operate the outriggers.

Still further, features of this invention relate to providing a pair of spaced outriggers which are each pivotally connected to the frame and which lie in a generally common horizontal plane when in a road travel position and which are movable into generally parallel vertical planes when in a ground support position for supporting the hopper when being unloaded.

Other objects and features of this invention will more fully become apparent in view of the following detailed description of the drawings which show a single embodiment and in which:

ON THE DRAWINGS

AS SHOWN ON THE DRAWINGS

Figures 1, 2, 3:
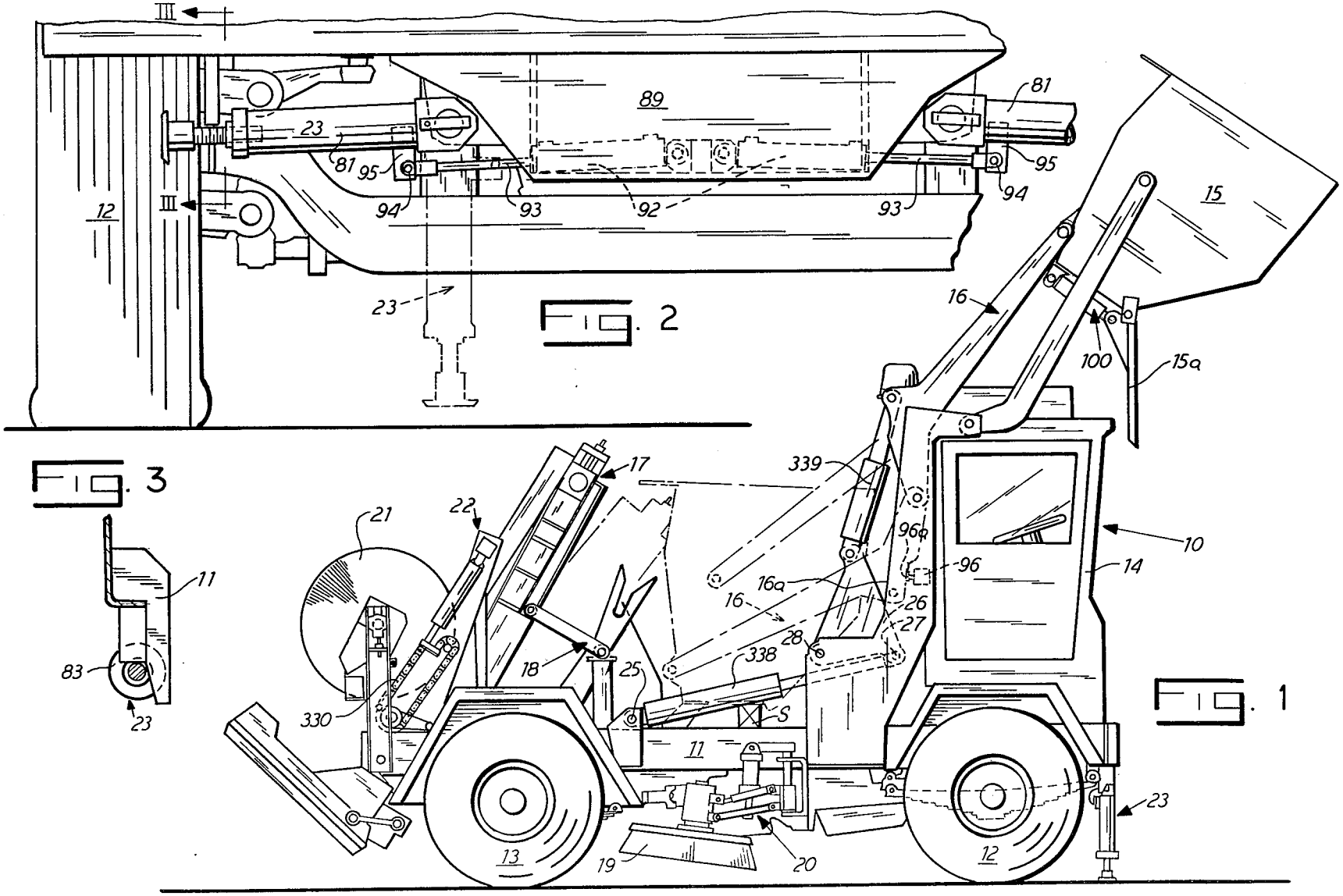
FIG. 1 is a side view of a four-wheeled sweeper having an elevating hopper that is shown in full and dotted lines and with hydraulically movable outriggers for supporting a forward end of the sweeper when the hopper is elevated.
FIG. 2 is an enlarged fragmentary view with the outriggers shown in full and dotted lines for the purpose of illustrating road travel and ground engaging positions.
FIG. 3 is a fragmentary sectional view along the line III—III of FIG. 2.

The reference numeral 10 indicates generally a self-propelled, four-wheeled street sweeper of the type that is particularly adapted to travel at high speeds on the open highways when loaded or unloaded and which is also capable of operating at slower speeds when sweeping the streets. The street sweeper 10 includes a main frame 11 that is supported by a front axle mounted on a pair of front wheels 12 and a rear axle mounted on a pair of rear wheels 13. An operator's cab 14 is disposed at the front end of the sweeper 10 above a single engine. Immediately behind the cab is a dirt hopper 15 that is ordinarily supported on the main frame 11 when positioned to receiving sweepings and which is elevatable over the cab for unloading the sweepings from the hopper. A powered hopper elevating mechanism 16 is provided for moving the dirt hopper in an arc from its sweeping receiving position behind the cab to its dumping position over the cab 14. The details of the powered hopper elevating mechanism 16 is described in assignee's U.S. Pat. No. 4,178,647 entitled "Four-Wheeled Sweeper". Before the mechanism 16 can be operated, and in accordance with important features of this invention, outriggers 23,23 are operated through the controls to provide support for the cab end or forward end of the sweeper for the time when the hopper 15 is elevated over the cab as will be more fully described hereafter.

Shiftably mounted on the frame immediately behind the dirt hopper 15 is a tiltable sweepings conveyor 17. The conveyor 17 is adapted to transport sweepings from ground level to an elevated position into the hopper 15 when the hopper is positioned for receiving the sweepings. Pivotal linkage means 18 is provided for tilting a conveyor 17 to move its upper end so the hopper may be moved through its arc while supported by the powered hopper elevating mechanism 16 free of interference with the conveyor 17.

Supported on the frame 11 at its opposite sides are a pair of side brooms 19. If desired, only one side broom can be used. The pivotal linkage 18 for tilting the conveyor 17 is operated by the powered hopper elevating mechanism 16. Means 20 is provided for moving the side brooms from a transport position to a sweeping position. When in a sweeping position, the brooms 19 are rotatable to throw sweepings from the gutter into the path of main broom 21. Main broom 21 is rotatable to throw the sweepings onto conveyor 17 and the conveyor cleats are adapted to transport the sweepings and unload the same into the dirt hopper 15 in a conventional manner.

Positioned at the rear end of the sweeper 10 is a main broom 21. Means 22 including powered linkage 330 is provided for moving the main broom 21 alternatively from a transport position to a sweeping position.

The main broom 21 operation and mechanisms for operating the same are described in greater detail in the assignee's U.S. application for patent entitled "Street Sweeper and Main Broom Suspension," U.S. Ser. No. 036,008.

Figure 6:
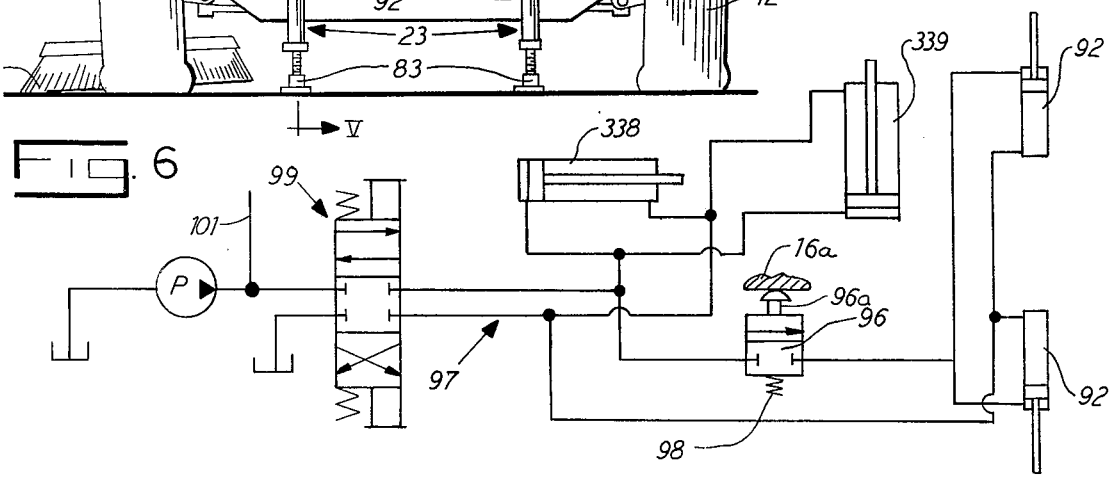
FIG. 6 is the hydraulic schematic diagram showing the components for operating the outrigger circuit.

The sweeper 10 is provided with means or linkage for raising the lowering the conveyor from a road traveling position to a sweeping position as shown in FIG. 6 of U.S. Pat. No. 4,171,551. This control is also shown in the hydraulic circuit (FIG. 7) of assignee's copending application, U.S. Pat. No. 4,171,551.

The powered hopper elevating mechanism 16 for moving the hopper for dumping includes two pairs of coacting cylinders with the first pair being identified as 338 in FIG. 1 and with the other pair being identified as 339. Since the operation of the cylinders 338 and 339 with the other components of the powered hopper elevating mechanism 16 are identical, a description of the manner of operation of one side of the mechine will suffice for the other side. Hand-operated controls for operating the hydraulic cylinders are located in the cab for the operator and these are also shown and described in the hydaulic circuit in U.S. Pat. No. 4,171,551. It will be appreciated that other improvements to the machine 10 are being more fully disclosed in other companion U.S. Pat. No. 4,171,551.

Figure 4:
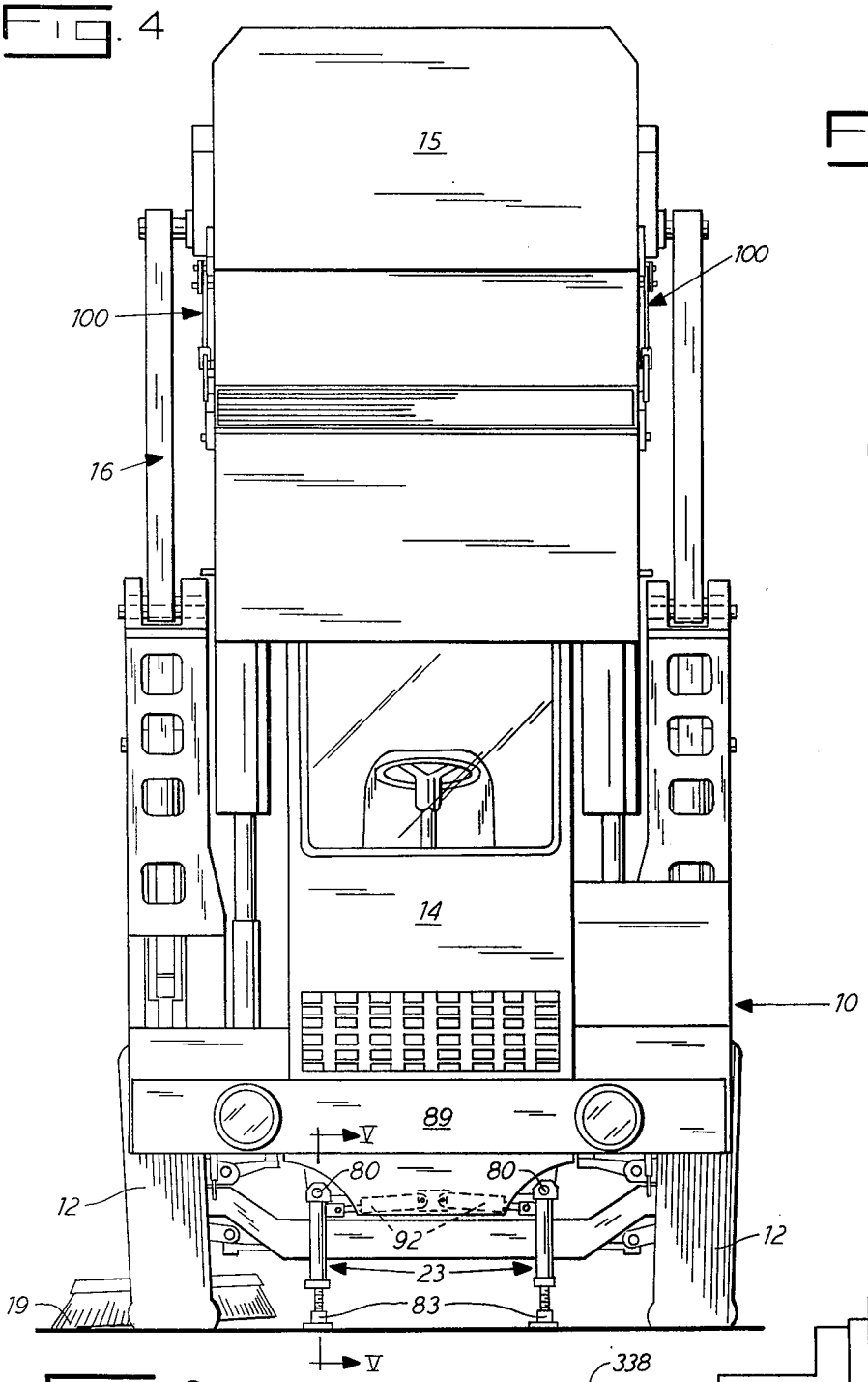
FIG. 4 is a front view of the four-wheeled sweeper shown in FIG. 1.
Figure 5:
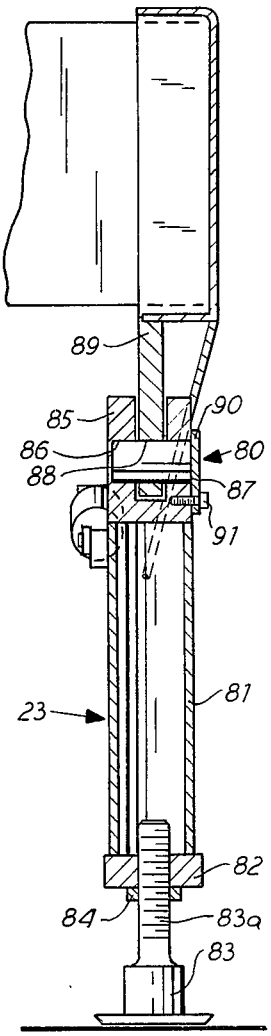
FIG. 5 is an enlarged fragmentary cross-sectional view taken substantially on the line V—V of FIG. 4 looking in the direction indicated by the arrows.

The outriggers 23 are each pivotally mounted on the frame at 80. These outriggers 23 each include a tubular section 81 having a mounting plate 82 at a lower end. A ground engaging foot 83 is provided at the lower end of the outrigger 23 which foot has a threaded foot end **83*a* that is threadingly engaged and secured with the outrigger plate 82. A lock nut 84 is provided to secure the adjustment of the outrigger foot in a conventional manner. The outrigger 23 each has an upper outrigger end 85 that is provided with a transverse bore 86 and a retaining pin 87 extends into the bore and through an aperture 88 provided in the frame or bumper 89. The pin 87 has a flanged end 90 and a lock pin or screw 91 is provided for retaining the lock pin in assembled position to insure against accidental disengagement of the outrigger 23 from the frame 89. In addition to the foregoing and as seen in FIG. 2, a pair of double acting hydraulic cylinders 92,92 are mounted on the frame 11 or bumper 89. These cylinders 92 are provided with extendible and retractable ram means 93,93. The ram means or piston arms 93,93 are pivotally connected at 94 to outrigger links 95. The outrigger links 95 are fixedly attached at one end to the tubular section 81 of each of the outriggers. It will thus be seen from a consideration of FIGS. 2 and 4 that when the outriggers are in a road travel position as shown by the full line illustration of the outriggers 23 in FIG. 2, the outriggers are generally in a common horizontal plane and the ram means of the cylinders 92 are in an extended position. When the outriggers are caused to be moved into a dumping position, the ram means 93 or the piston rods are moved to a retracted position as shown in FIG. 2. The full line illustration of the piston rod 93 shows it in a road travel position and the dotted line illustration shows the piston rod in a dumping position. When in a dumping position, the outriggers 23 are disposed in parallel vertical planes as illustrated in FIG. 4 with the feet 83** engaged upon the ground.

Operation of Outriggers and Description of Circuit

With the hopper 15 at rest on its stops S, a lower lift arm **16*a* (FIG. 1) is in contact with a two-way blocking valve 96 which is a component of a hydraulic circuit 97 embodying features of this invention. The blocking valve 96 is manually operable and has a push button end 96*a* which is open when in an extended position and closed when in a retracted position. The blocking valve 96 has a spring actuator 98 to extend the push button end 96*a* to close the blocking valve 96 when the lift arm 16** is disengaged from the push button end.

When a manually operable control or directional valve 99 is moved to raise the hopper, oil begins to flow by operation of a pump P (FIG. 6) in the direction indicated by the arrows. This valve 99 is operated by a hand-operated control level (not shown) in the cab 14 in a conventional manner.

According to certain safety features of this invention, the outrigger cylinders 92 require a much lower force to operate than is required to lift the hopper and first move to lower the outriggers so the front end of the sweeper will be supported before the hopper 15 is moved to its dump position to prevent the sweeper from tipping and to maintain the hopper load in a balanced supported position on the sweeper at all times.

When the outriggers 23,23 are completely lowered into ground engagement, the hopper 15 then begins to raise. As the hopper 15 is raised approximately one inch off its stop S, the lift arm 16 has moved away from the push button end 97 of the blocking valve 96 allowing the blocking valve to close, blocking that fluid line and thus stopping in and out flow of fluid to either side of the double acting outrigger cylinders 92, according to other features of our invention. This action keeps the outriggers 23 down through the rest of the raise and lower cycle of the double acting hopper elevating cylinders 338 and 339 until the hopper 15 is lowered to within approximately one inch of its stops S and the lower lift arm **16*a* again engages the push button end 97 of the blocking valve 96, manually opening the blocking valve 96, allowing oil to flow to and from the double acting outrigger cylinders 92 and thereby causing the outriggers 23 to be raised. The advantage of the blocking valve (96) is that the hopper lifting and lowering and outrigger positioning is accomplished with a single manual valve application by the operator in the cab, and happens automatically. It could be done by adding another manually operated valve in the cab but then the operator would be required to manually operate the outrigger valve. Also, hydraulically operated hopper door operating mechanisms 100 are provided for opening and closing a hopper door 15***a*. According to other features of the invention, all of the hydraulic components can be operated through the same hydraulic pump P. In FIG. 6, fluid line 101 is provided for connection to the remainder of the hydraulic circuit for operating other hydraulically powered units all from the same pump such as are shown in the companion application in FIG. 8, supra.

We claim as our invention:

1. A street sweeper having a frame, a cab positioned at a forward end of the frame, a hopper for receiving sweepings carried on the frame behind the cab, linkage for enabling the hopper to be moved over the cab to a forward dumping position, outriggers positioned at a forward end of the sweeper, hydraulic circuit means, valve means, and ram means collectively cooperable together and sequentially operable to initially move the outriggers into ground engagement to provide additional support for the hopper when in said forward dumping position and then operable to actuate said linkage to move said hopper over the cab for dumping.

2. A street sweeper of claim 1 further characterized by said valve means being operable to block fluid flow in and out of the outrigger ram means thus maintaining the outriggers in ground engagement as the hopper is raised and lowered and until the hopper is lowered to a predetermined point when said outrigger valve means is operative to actuate the outrigger ram means and to allow the outriggers to be raised into a travel position.

3. The street sweeper of claim 1 further characterized by said outriggers comprising a pair spaced from one another pivotally connected to said frame and lying in a generally common horizontal plane when in a road travel position and in generally parallel vertical planes when in a ground support position for supporting the hopper when being unloaded.

4. The street sweeper of claim 3 further characterized by said ram means being pivotally connected to said outriggers and providing means for moving said outriggers through an arc from a road travel position to a ground engaging position with said outriggers having ground engaging feet for supporting the sweeper.

5. The street sweeper of claim 1 further characterized by said hydraulic circuit and said valve means including circuit line blockage means to cut off fluid pressure to said outriggers after the hopper has been lifted a predetermined distance off of said frame to maintain the outriggers in a ground engaging support position as the hopper is moved to its forward dumping position and until the hopper is returned to said predetermined position to deactivate said circuit line blockage means so that fluid pressure can be passed freely through said hydraulic circuit to allow said outriggers to be retracted into a road travel position.

6. The sweeper of claim 1 further characterized by said valve means including a single manually operable control valve for causing the outriggers and the hopper to be lowered and raised.

7. The sweeper of claim 6 further characterized by said valve means further including a push button blocking valve hydraulically connected to said ram means for actuating said outriggers, the blocking valve being actuable to allow said ram means to lower said outriggers when said manually operable control valve is initially actuated and before movement of said hopper commences to insure that the front end of the sweeper is supported before by the outrigger before dumping commences.

8. The sweeper of claim 1 further characterized by said valve means including a single manually operable control valve for causing the outriggers and the hopper to be lowered and raised, said valve means further including a push button blocking valve hydraulically connected to said ram means for actuating said outriggers, the blocking valve being actuable to allow said ram means to lower said outriggers when said manually operable control valve is initially actuated and before movement of said hopper commences to insure that the front end of the sweeper is supported before by the outrigger before dumping commences.

9. The sweeper of claim 8 further characterized by said push button end of the blocking valve being actuable to an open position to actuate said ram means to retract said outrigger cylinder to their road travel position when said control valve is moved to cause said hopper to move from its elevated dumping position to its road travel position.

10. The sweeper of claim 1 further characterized by said linkage for moving the hopper over the cab and said ram means to move the outriggers being all operable by a single hydraulic pump.

11. The sweeper of claim 1 further characterized by hydraulic cylinders being provided for actuating said linkage for causing the hopper to be elevated into its dumping position, said hydraulic cylinders being connected with said hydraulic circuit means and being operable after the outriggers have been moved into their ground engaging position.

* * * * *